US007463743B2

(12) United States Patent
Lechner

(10) Patent No.: US 7,463,743 B2
(45) Date of Patent: Dec. 9, 2008

(54) ELECTRONIC DRIVING CIRCUIT FOR DIRECTING AN AUDIO SIGNAL SELECTIVELY TO ONE OF TWO SPEAKERS

(75) Inventor: Thomas Lechner, Kirchheim (DE)

(73) Assignee: Sony Ericsson Mobile Communications AB, Lund (SE)

( * ) Notice: Subject to any disclaimer, the term of this patent is extended or adjusted under 35 U.S.C. 154(b) by 177 days.

(21) Appl. No.: 10/546,255

(22) PCT Filed: Jan. 21, 2004

(86) PCT No.: PCT/EP2004/000462

§ 371 (c)(1),
(2), (4) Date: Jul. 10, 2006

(87) PCT Pub. No.: WO2004/075602

PCT Pub. Date: Sep. 2, 2004

(65) Prior Publication Data

US 2006/0262945 A1 Nov. 23, 2006

(30) Foreign Application Priority Data

Feb. 20, 2003 (EP) ..... 03003829

(51) Int. Cl.
*H04R 3/00* (2006.01)

(52) U.S. Cl. ..... 381/111; 455/569.1; 379/420.02

(58) Field of Classification Search ..... 381/111, 381/116–117, 77–81, 85, 123; 379/428.02, 379/420.02; 455/518, 550.1, 553.1, 221, 455/255, 569.1, 569.2, 570
See application file for complete search history.

(56) References Cited

U.S. PATENT DOCUMENTS

| | | | | |
|---|---|---|---|---|
| 3,560,656 | A * | 2/1971 | Gilbert | 381/17 |
| 4,611,135 | A | 9/1986 | Nakayama et al. | 307/572 |
| 5,418,841 | A * | 5/1995 | Haraguchi et al. | 379/70 |
| 5,978,689 | A * | 11/1999 | Tuoriniemi et al. | 455/569.1 |
| 6,091,812 | A | 7/2000 | Iglehart et al. | 379/308 |
| 6,567,655 | B1 * | 5/2003 | Wietzke et al. | 455/345 |
| 2003/0013461 | A1 * | 1/2003 | Mizune et al. | 455/456 |
| 2003/0021428 | A1 * | 1/2003 | Abe et al. | 381/97 |
| 2004/0228476 | A1 * | 11/2004 | Denninghoff | 379/428.02 |

FOREIGN PATENT DOCUMENTS

GB 2310577 A 8/1997

OTHER PUBLICATIONS

"LM4855 Integrated Audio Amplifier System," National Semiconductor Data Sheets, Nov. 1, 2002, pp. 1-24.

* cited by examiner

*Primary Examiner*—Paul Disler
(74) *Attorney, Agent, or Firm*—Myers Bigel Sibley & Sajovec, P.A.

(57) ABSTRACT

A driving circuit selectively operates a hands-free loudspeaker and an earpiece speaker of a mobile terminal. The driving circuit includes a voiceband electronic circuit with a balanced output adapted for being switched between an in-phase and an opposite-phase mode, an interconnection function for connecting the earpiece speaker directly to the balanced output of the voiceband circuit, and an adder circuit for adding signals supplied by each port of the balanced output and for providing the sum-signal to the hands-free loudspeaker.

4 Claims, 2 Drawing Sheets

ELECTRONIC DRIVING CIRCUIT FOR DIRECTING AN AUDIO SIGNAL SELECTIVELY TO ONE OF TWO SPEAKERS

RELATED APPLICATIONS

The present application is a 35 U.S.C. §371 national phase application of PCT International Application No. PCT/EP2004/000462, having an international filing date of Jan. 21, 2004, and claiming priority to European Patent Application No. 03003829.3, filed Feb. 20, 2003, the disclosures of which are incorporated herein by reference in their entireties. The above PCT International Application was published in the English language and has International Publication No. WO 2004/075602 A1.

BACKGROUND OF THE INVENTION

The present invention relates to an electronic driving circuit for a selective use of two electro-acoustic transducers of a mobile terminal.

Common mobile terminals like e.g. mobile phones, personal digital assistants (PDA) or the like, are equipped with an earpiece speaker and a buzzer as standard acoustic components. The earpiece speaker is hereby typically used to transduce an audio signal provided by a voiceband electronic circuit of the mobile terminal into a respective sound signal. Other signals, like e.g. ringing tones or alarms are usually produced in form of square wave signals with variable pulse width and are transduced into a respective sound signal by a so-called buzzer. On many current mobile terminals, particularly on high-grade models, the buzzer is replaced by a hands-free speaker, which will in the following be referred to as loudspeaker. This loudspeaker usually not only transduces square wave buzzer signals, but is also used for reproducing ringer tones which are often provided in the form of polyphonic melodies. The loudspeaker is further used to transduce audio signals originating from the voiceband electronic circuit like the earpiece speaker but at a higher sound level than that, for to enable a user to operate the mobile terminal in hands-free mode. For this purpose, an audio power amplifier external to the voiceband electronic circuit is wired between an output of the voiceband electronic circuit and the loudspeaker. The loudspeaker is either connected to a separate output of the voiceband electronic circuit or it shares the only one output provided with the earpiece speaker.

The outputs provided by the voiceband electronic circuit are either single ended or balanced. The voiceband electronic circuit is typically formed by an integrated circuit which allows to configure the details of its last processing stage supplying an audio signal to the one or more output ports of the voiceband electronic circuit. The audio signal on one output port may thereby be of equal or different phase than at another port of the outputs provided. The audio signals present at the one or more outputs are then processed by an external circuit which supplies the two speakers.

Three different types of external circuits are currently used to wire the speakers, i.e. the loudspeaker and the earpiece speaker to a voiceband electronic circuit. In a first type, each speaker is supplied from a separate, single-ended or balanced output of the voiceband electronic circuit. A balanced output provides the signal at each of its two ports. By default the phase of a signal at a first port is of opposite phase to that of the respective other port. Different from the general meaning, the term 'balanced output' as used in this specification denotes an output where the phase of a signal at a first of its ports has a defined relationship to that of the signal present at the respective other port.

A second commonly used external circuitry uses just one output of the voiceband electronic circuit for supplying both, the earpiece speaker and the loudspeaker. While the earpiece speaker is usually directly connected with the output, a power amplifier is set between the output and the loudspeaker for additionally amplifying the audio signal. The audio power amplifier typically comprises a control port by which the amplifier can be switched on or off. There are only two modes of operation possible. In the first, only the earpiece speaker is active, in the second both, the earpiece speaker and the loudspeaker are active.

Very often, the last type of external circuit is modified to such as to additionally allow a square wave buzzer signals to be transduced by the loudspeaker. The audio power amplifier for the loudspeaker is wired in this third type of external circuit for to form an adder circuit which allows the loudspeaker to reproduce the audio signal as well as the buzzer. In this commonly used type of wiring, an additional analogue switch is necessary to disconnect the audio signal from the audio power amplifier when transmitting the buzzer signal. Otherwise the audio signal from the voiceband electronic circuit output would be audible when the audio power amplifier has to be turned on for reproducing the buzzer signal.

Although, the last two types of external circuitry are usually preferred as only one output for the audio signal has to be provided at the voiceband integrated circuit, these types of wiring are disadvantageous in that the audio signal is always present on the earpiece speaker of the respective mobile terminal.

SUMMARY OF THE INVENTION

It is therefore an object of the present invention to provide an electronic circuit using only a minimal count of components and allowing to direct an audio signal provided by only one output of a voiceband electronic circuit selectively to either the earpiece speaker or the loudspeaker.

This object is achieved by a driving circuit as claimed in the independent claim 1. The driving circuit for selectively operating a hands-free loudspeaker and an earpiece speaker of a mobile terminal has a voiceband electronic circuit with a balanced output adapted for being switched between an in-phase and an opposite-phase mode and an interconnection means for connecting the earpiece speaker directly to the balanced output of the voiceband electronic circuit. Further, an adder circuit adds the signals supplied by each port of the balanced output and provides the sum-signal to the hands-free loudspeaker.

The invention uses the fact, that a balanced output of a voiceband integrated circuit can be operated in two modes. In a first mode, the audio signal is provided on both ports of the output in-phase, while in the second mode the signals provided are of opposite-phase. Thus, the adder circuit will produce a zero sum signal for the second mode which corresponds to a turn-off of the audio signal provided to the loudspeaker without the necessity of employing an analogue switch as in the prior art. At the earpiece speaker, the opposite-phase signals correspond to an audio signal of double amplitude allowing it to produce a sound corresponding to a currently present audio signal. In the other mode, the earpiece speaker is silent while the loudspeaker transduces the audio signal. Without a necessity for external control devices, like for instance an analogue switch or the like, the electronic circuit of the present invention makes advantageously use of the control functions already provided by a voiceband electronic circuitry used in mobile terminals.

In a further special embodiment of the present invention, the adder circuit is effectively adapted to add a buzzer signal provided by a buzzer port of the mobile terminal to the sum of the audio signals supplied by the balanced output of the voiceband circuit. Thus, a square wave buzzer signal typically used as an alarm or reminder signal, will be transduced by the loudspeaker only and will not bother a user while listening to the sound reproduced by the earpiece. Advantageously, the adder circuit comprises a control port for controlling the activation of the adder circuit which enables a user to control if a buzzer signal will be reproduced by the loudspeaker or not.

BRIEF DESCRIPTION OF THE DRAWINGS

In the following, the present invention will be explained in detail with reference to special embodiments and referring to the figures enclosed, in which.

DETAILED DESCRIPTION OF EMBODIMENTS

Figure 1:
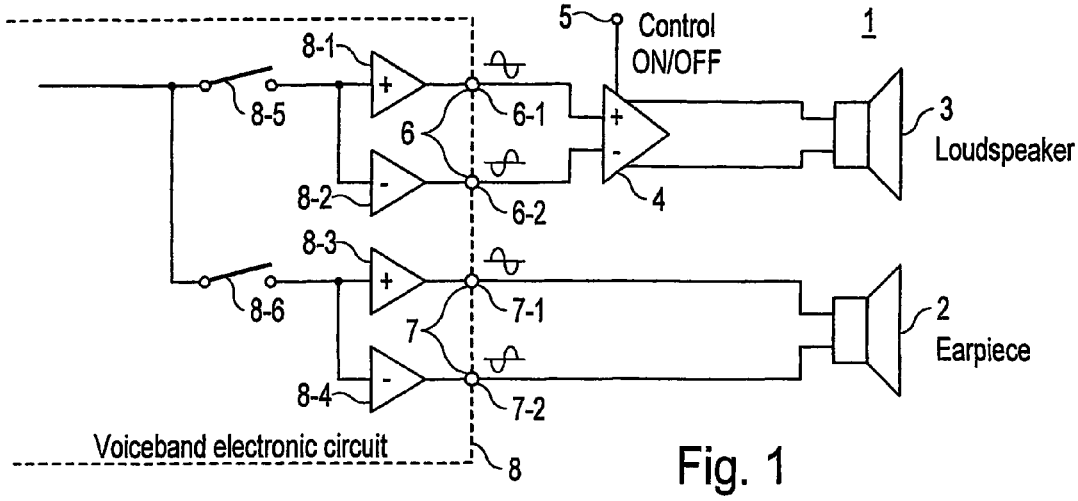
FIG. 1 is a first prior art example using two separate audio outputs of a voiceband electronic circuit for each speaker.

The circuit diagram of FIG. 1 shows a first example of a commonly used electronic driving circuit for distributing an audio signal provided by a voiceband electronic circuit 1 to an earpiece speaker and/or a loudspeaker of a mobile terminal. The electronic driving circuit 1 is formed by a voiceband electronic circuit 8 indicated by an enclosing dashed line in FIG. 1, and by a circuitry external to it. This external circuit contains the earpiece speaker 2, the loudspeaker 3 and the audio power amplifier 4 for amplifying the difference of the audio signals provided at each of the two output ports 6-1 and 6-2 of the voiceband integrated circuit output 6. The audio power amplifier can be switched on or off by means of a control port 5 available at the audio amplifier 4. An audio signal generated or processed within the voiceband electronic circuit is directed by a switching means 8-5 or 8-6, respectively, to either the output stage for the loudspeaker or that for the earpiece speaker. The switching means 8-5 and 8-6 are typically formed by an electronic device like a transistor or the like which can be easily controlled by a control logic of the mobile terminal. The output stage for the loudspeaker 3 comprises an amplifier 8-1 which processes the audio signal in a non-inverting way and an amplifier 8-2 which inverts the audio signal. The audio signal provided on the two ports 6-1 and 6-2 of the output port 6 is thereby provided with opposite phases. The output stage for the second port 7 supplying the earpiece speaker is formed identical to the one described for the loudspeaker. For an audio signal to be transduced by the loudspeaker 3, the switch 8-5 is closed while the switch 8-6 disrupts the connection to the output stage for the output 7 of the voiceband electronic circuit. Thus, the audio signal is exclusively reproduced by the loudspeaker 3. In the other mode, switch 8-5 is open and switch 8-6 is closed resulting in an exclusive reproduction of an audio signal by the earpiece speaker.

Figure 2:
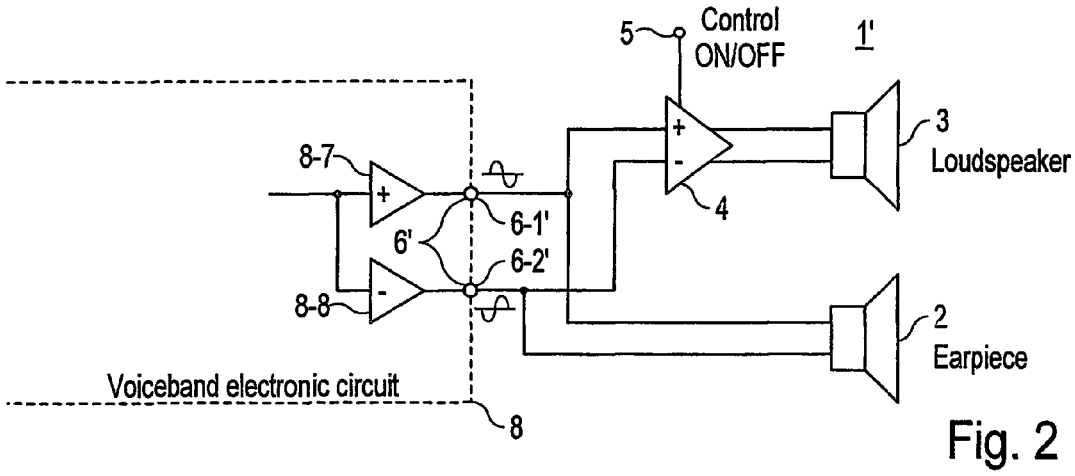
FIG. 2 is a second prior art example where the audio signal supplied by only one balanced output port of a voiceband electronic circuit is distributed to both, the earpiece speaker and the loudspeaker.

A second, commonly used type of an electronic driving circuit 1' for a mobile terminal with a loudspeaker is shown in FIG. 2. Here, only one output stage is present with the non-inverting amplifier 8-7 and the inverting amplifier 8-8 providing an opposite-phase audio signal at the two ports 6-1' and 6-2' of the output port 6'. The earpiece speaker 2 is directly connected to the output port 6' so that any audio signal produced by the voiceband electronic circuit 8 will be transduced by the earpiece speaker 2. Wired in parallel to the earpiece speaker, an audio power amplifier 4 receives the signal from output port 6', amplifies it and supplies it to the loudspeaker 3. By applying a respective control signal to the control port 5 of the audio power amplifier 4 a user can turn the loudspeaker 3 on or off at his will. The earpiece speaker however cannot be turned on or off, so that it will always produce a sound corresponding to an audio signal present at the output 6'. It is to be noted that the earpiece speaker not only denotes a speaker arranged within the mobile terminal casing, but maybe also be formed by sort of headphone which can be plugged into the mobile terminal for being used external to it.

Figure 3:
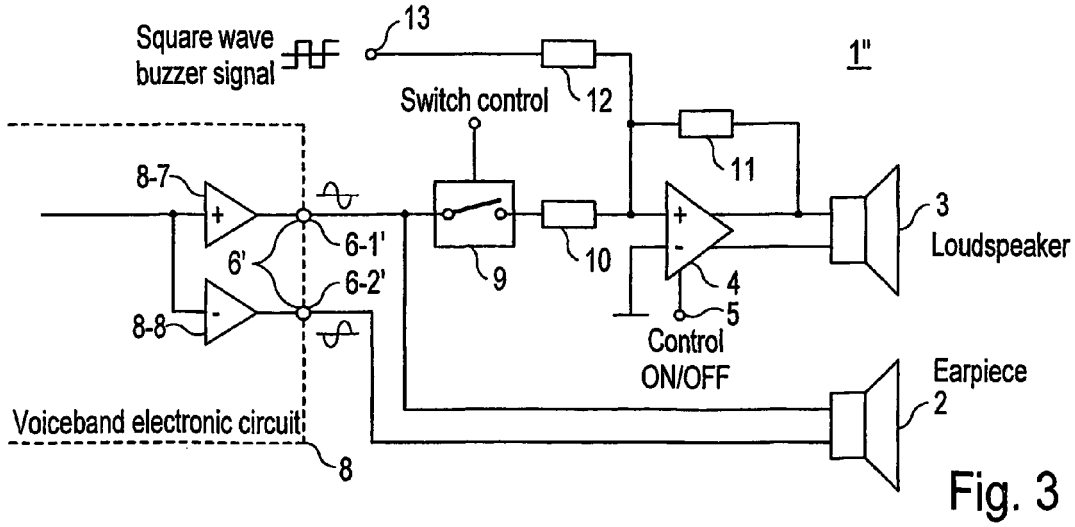
FIG. 3 is a third prior art example combining the example of FIG. 2 with an additional port for providing a square wave buzzer signal to the loudspeaker.

Many mobile terminals not only provide polyphonic melodies for reminder or alarm signals, but also a square wave buzzer signal which a user can select for a respective purpose. The square wave buzzer signal is usually not produced within the voiceband electronic circuit but by a different circuitry and has to be supplied to the driving circuit external to the voiceband electronic circuit via an extra port 13. The audio amplifier 4 is wired to this end to form an adder circuit with an input resistance 12 for the buzzer signal and a further input resistance 10 for the audio signal and a feedback resistor 11. To allow an exclusive transmission of either the buzzer signal or the audio signal to the audio power amplifier 4 a switch control 9, like e.g. an analogue switch has to be placed between resistor 10 and the output port 6-1' of the voiceband electronic circuit 8. Besides being an additional electronic device, the switch control line needs an extra wiring to a logic control circuit of the mobile terminal. Further, like in the example of FIG. 2, the earpiece speaker cannot be turned on or off which is a major disadvantage of the driving circuitry 1" shown in FIG. 3.

Figure 4A:
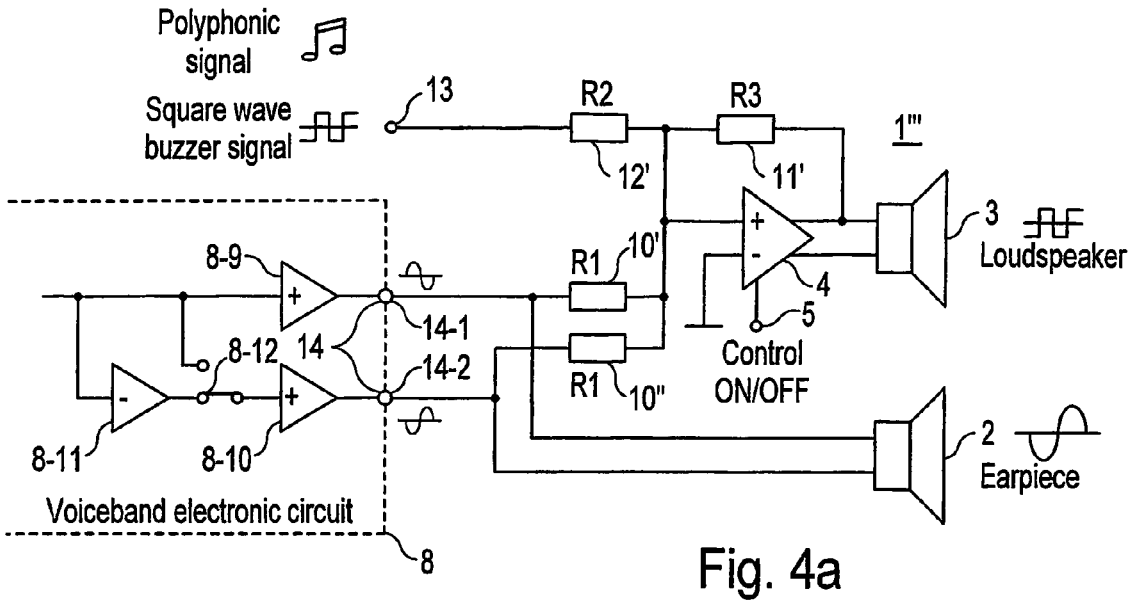
FIG. 4*a* shows a special embodiment of an electronic circuit according to the present invention in a mode, where the audio signal is directed exclusively to the earpiece speaker.
Figure 4B:
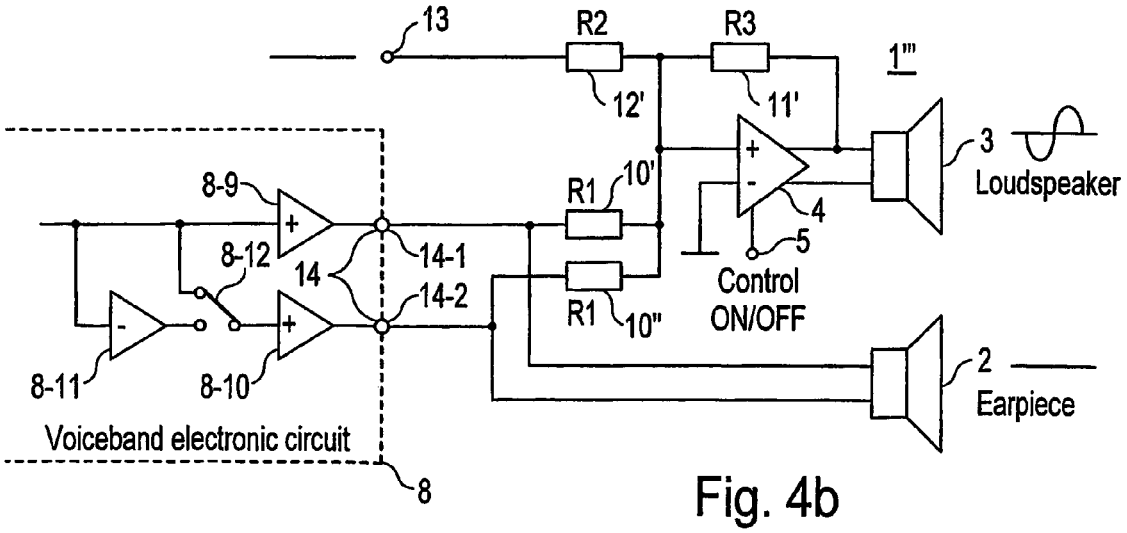
FIG. 4*b* shows the electronic circuit of FIG. 4*a* but in a mode where the audio signal provided by the voiceband electronic circuit output is exclusively supplied to the loudspeaker.

The present invention makes use of the fact, that the configuration of an audio output of the voiceband electronic circuit can be configured according to the requirements the output has to serve. A driving circuit 1''' according to the present invention is shown in FIGS. 4*a* and 4*b*. Instead of using just a non-inverting and an inverting amplifier for the output stage of the voiceband electronic circuit 8, the inverting amplifier is replaced by a serial arrangement of an inverting amplifier 8-11 and a non-inverting amplifier 8-10. A switching means 8-12 placed between the inverting and the non-inverting amplifier allows to connect the input of the non-inverting amplifier 8-10 to either the output of the preceding inverting amplifier 8-11 or directly to the audio signal line of the voiceband electronic circuit 8. The output port 14 can be operated by the switching means 8-12 in opposite mode as shown in FIG. 4*a* or in in-phase mode as shown in FIG. 4*b*. The switching means 8-12 is controlled by a logic control circuit of a mobile terminal connected to the voiceband electronic circuit 8.

The function of the electronic driving circuit external to the voiceband electronic circuit 8 is now described with reference to FIG. 4*a* showing it with the output port 14 operated in opposite-phase mode. In this mode, the audio signal which is present at output port 14-2 is the inverse of the audio signal present at output port 14-1. As the earpiece speaker 2 is directly connected to the output 14 the potential difference present on the speakers pins is just the double of each audio signal at each of the ports 14-1 or 14-2. The earpiece speaker 2 will therefore transduce the audio signal into a respective sound signal.

The audio signals provided from the two output ports 14-1 and 14-2 are further forwarded to an adder circuit via the resistance 10' and 10" of equal value R1. As adder circuits are well known in the art, its particular function will not be explained here. For the audio signal of output port 14-2 being of opposite-phase than or the inverse of, respectively, the audio signal provided at the output port 14-1, the sum of both signals at the input of the audio amplifier 4 is zero, which means that no audio signal is present at the input of the amplifier 4. Operating the output port of the voiceband electronic circuit 8 in opposite-phase mode, therefore results in a reproduction of the audio signal by the earpiece speaker only, while the loudspeaker stays silent.

When the output port 14 is operated in in-phase mode as shown in FIG. 4*b*, the potentials present at the respective output ports 14-1 and 14-2 are at any time identical, which means that the potential difference at the pins of the earpiece speaker 2 is always zero so that it will not produce any sound. At the input of the audio power amplifier 4, the in-phase signals of the two output ports are added to a combined signal of double the amplitude provided at either one of the two output ports 14-1 or 14-2 thus providing an audio signal at the loudspeaker which will be transduced into a respective sound signal. By operating the output port 14 of the voiceband electronic circuit 8 in in-phase mode, the loudspeaker 3 will reproduce a sound signal while the earpiece speaker 2 will stay silent as indicated on the right of the speaker symbols.

In a further embodiment of the present invention an additional port 13 is provided by the driving circuit external to the voiceband electronic circuit. At this port 13 a square wave buzzer signal or any other, e.g. polyphonic or audio signal produced by a further circuitry of the mobile terminal can be applied for being reproduced by the loudspeaker 3. Like in the prior art, the respective signal will be supplied to the audio power amplifier 4 via an additional port of the adder circuitry formed by the resistance 12' of value R2. As the respective buzzer signal is only supplied to the amplification stage for the loudspeaker 3 it will not be transduced by the earpiece speaker 2. Thus, the loudspeaker can transduce a buzzer signal while the earpiece speaker reproduces an audio signal as indicated on the right of the speaker symbols.

Unlike in the prior art, the driving electronic circuit 1'" according to the present invention allows an exclusive passing on of an audio signal provided by only one port 14 of a voiceband electronic circuit 8 to either a loudspeaker or an earpiece speaker of a mobile terminal without the necessity of an additional switching means.

The invention claimed is:

1. A driving circuit for selectively operating a hands-free loudspeaker and an earpiece speaker of a mobile terminal, comprising:

a voiceband electronic circuit that is configured to provide an output on two output ports, wherein a phase of a signal at a first one of the output ports has a defined relationship to that of a signal at a second one of the output ports, the output being switchable between an in-phase mode in which the signals at the first one and second one of the output pods are in phase and an opposite phase mode in which the signals at the first one and the second one of the output ports are in opposite phase;

an interconnection means for connecting the earpiece speaker directly to the output on the two output ports of the voiceband circuit; and an adder circuit configured to add the signals supplied by the two output ports and to provide a sum-signal to the hands-free loudspeaker.

2. The driving circuit according to claim 1 wherein the adder circuit is further configured to add a buzzer signal supplied from circuitry of the mobile terminal separate to the voiceband electronic circuit to the sum-signal.

3. The driving circuit according to claim 1, wherein the adder circuit is further configured to add an audio signal supplied from circuitry of the mobile terminal separate to the voiceband electronic circuit to the sum-signal.

4. The driving circuit according to claim 1 wherein the adder circuit comprises a control port for controlling the activation of the adder circuit.

* * * * *